US006742751B1

(12) United States Patent
DeMoor

(10) Patent No.: US 6,742,751 B1
(45) Date of Patent: Jun. 1, 2004

(54) PADDED SAFETY DEVICE FOR INDIVIDUAL CRIB SLATS

(76) Inventor: Karen Louise DeMoor, P.O. Box 292767, Nashville, TN (US) 37229-2767

( * ) Notice: Subject to any disclaimer, the term of this patent is extended or adjusted under 35 U.S.C. 154(b) by 0 days.

(21) Appl. No.: 10/360,407

(22) Filed: Feb. 6, 2003

(51) Int. Cl.[7] ..... A47B 91/00

(52) U.S. Cl. ..... 248/345.1; 5/424; 5/425; 5/663

(58) Field of Search ..... 248/345.1; 428/102, 428/212, 220, 118, 123, 388, 403; 5/425, 424, 426, 663, 946, 93.1

(56) References Cited

U.S. PATENT DOCUMENTS 1,620,933 A * 3/1927 Wilcox ..... 52/717.01
2,203,921 A * 6/1940 Padjen ..... 5/100
3,430,272 A * 3/1969 Thorn, Jr. ..... 5/93.1
4,670,923 A * 6/1987 Gabriel et al. ..... 5/424
5,351,348 A * 10/1994 Beger ..... 5/420
5,410,765 A * 5/1995 Youngblood ..... 5/93.1
5,437,071 A * 8/1995 Feigenbaum ..... 5/663
6,026,528 A * 2/2000 Pina ..... 5/658
6,055,690 A * 5/2000 Koenig ..... 5/724
6,401,281 B1 * 6/2002 Younge ..... 5/663
6,564,403 B1 * 5/2003 Titus ..... 5/425
6,604,789 B1 * 8/2003 Downing ..... 297/227

* cited by examiner

*Primary Examiner*—Ramon O. Ramirez
*Assistant Examiner*—Amy J. Sterling
(74) *Attorney, Agent, or Firm*—Pro-se

(57) ABSTRACT

The present invention is a safety device used in an infant crib or playpen to protect its occupant from the individual hard (typically) wood vertical support posts (i.e., slats). A padded cushion is fastened around the entire crib slat, and has a solid, vertical support piece which is used to stabilize the pad in an upright, fixed position at all times. The safety support piece (i.e. stabilizing object) prevents an infant or toddler from pushing down on the pad and using it as a step to climb out of the crib.

1 Claim, 5 Drawing Sheets

PADDED SAFETY DEVICE FOR INDIVIDUAL CRIB SLATS

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISK APPENDIX

Not Applicable

BACKGROUND OF INVENTION

Parents and guardians of infants and toddlers spend most of their time protecting their young from danger. A newborn could choke on its vomit; an infant could roll off a bed during a diaper change; and a toddler could accidentally run through a set of glass doors, if not properly supervised. It is virtually impossible to watch a child 24 hours a day, seven days a week. Whether left alone to play in the crib, take a nap, or sleep during the night, a child is never more unsupervised than the time spent in the crib. According to safety experts, most accidents occur in the crib because children are left alone for long periods of time. Because the structure of a crib appears to be a safe place to leave a child, parents and guardians often have a false sense of security. They place a bumper pad inside the crib to help cushion inevitable falls, only to remove it when the infant is able to sit up unassisted (around 6–9 months). An infant at this stage could easily push down on the pillow-like pad and use it as a step to climb out of the crib. Once the bumper pad is removed, the crib slats are left unprotected, and so is the occupant inside. The present invention overcomes this safety issue; it can be used in the crib from the time the baby is born, until it can sleep in a regular or toddler bed (usually around 2–3 years of age). Unlike a conventional bumper pad, the present invention is a padded safety device that is affixed around the individual vertical supports of a crib, and includes an object that stabilizes the pad in a fixed, vertical position so it may not be pushed down and used as a step.

While researching for prior art similar to the present invention, a product with U.S. Pat. No. 5,437,071 was discovered, herein known as the "prior art", which is a comparative product to protect infants and toddlers from injuring themselves on the material that comprise a crib or playpen, after the bumper pad is removed. A crib or playpen is typically described as made of wood, with four sides comprised of two parallel horizontal railings, with individual vertical supports, herein known as, "crib slats", connected between them. The crib slats are usually rectangular in shape, four-sided, approximately 1 to 1½ inches wide, ½ inch thick, spaced approximately 2⅜ inches apart, and are about 26 inches high, depending on the style and type of crib. There are an estimated 50 slats that comprise a typical crib, again, depending on the style and type of crib (see FIG. 5 for a drawing of a typical crib). The crib typically has a horizontal spring that supports the crib mattress. According to safety experts, the mattress should have no more than an approximate gap of 1½ inches (a "two finger" width) between the mattress and the crib slat. A gap larger than this presents a safety hazard of child entrapment and suffocation. Padding inside the crib is necessary to prevent an infant or toddler from injuring themselves when they come in contact with the hard crib slats.

The prior art describes in its "Background of the Invention" section the disadvantages of the commonly used crib bumper pad. To summarize, bumper pads are a cushioned material, similar to a pillow, that encompass the entire inside perimeter of a crib, widely used and accepted by parents and guardians to protect their child from injury in case the child would fall against the hard, wooden slats. Bumper pads are usually about one foot high, normally are of one piece, and are typically fastened by strings tied around the crib slats. The disadvantages of bumper pads include: (1) the inability of a parent or guardian to view a child while the child is lying in the crib, unless the parent or guardian is standing next to the crib and views the child from the top of the crib and looks down; (2) an infant, while lying in the crib, is unable to view its outer world; (3) bumper pads offer the ability of an older infant to use it as a step to climb out of the crib (the potential for injury is limitless in this case); (4) are difficult to use when lowering the side rail of a crib to reach a child (because the bumper pad is tied to the crib slat, it moves with the slat and does not stay in one place), and (5) due to the raising and lowering of the crib rail, the ties may become loose, and potentially allow for the bumper pad to fall onto an infant who may not have the strength to push it off, thus creating a suffocation hazard. Because of the safety issues mentioned above, bumper pads are typically removed when an infant can sit up or stand by him or herself.

Bumper pads or padding of some form, however, are a basic necessity to protect mobile infants or toddlers from injuring themselves on the crib slats. The next step to improve upon the bumper pad is to have an invention similar to the prior art. The prior art describes a pad that covers most of the vertical length of each individual crib slat, and is padded on 1 to 3 sides. The cover is comprised of either vinyl or some "flexible material" (see prior art's "Summary of Invention" section), and is filled with a "cushioning material" (see prior art's "Summary of Invention" section). The advantages of this include: (1) the parent or guardian can now view their child through the slats in the crib; (2) the child can see the "outer world"; and (3) the padding should protect the infant from injury.

While there are many advantages of a slat pad over a bumper pad, there are still disadvantages to the prior arts' design. The prior art has disadvantages that could ultimately cause severe injury for infants and toddlers. Disadvantages include:

1) The prior art has padding only on one to three sides, and none on the exterior of the crib slat. This is a disadvantage because in the everyday usage of the crib, the product could potentially turn, thus leaving the interior of the slats exposed to the side of the product that does not have the padding. This could lead to injury of the child inside, if the interior slat is left unprotected.

2) The prior art drawing of the product (see its drawings, FIG. 1) shows the cover is fastened on the right-hand side of the pad. This would allow for the right side of the pad to be wider, and stick out further, than the left side. Due to this disadvantage, the aesthetic appearance of the pad and crib slat would be affected. It also may not leave enough room between the next slat to the right to view the baby.

3) The prior art product appears to be pre-formed (or pre-molded), (see drawing of the prior art, FIG. 1), is of one shape, and has a slit that opens when placed onto the crib slat, which may cause the inability to fit onto crib slats of different sizes.

4) The prior art does not cover the crib slat below the mattress (see prior art drawing, FIG. 3); the prior art states in the "Detailed Description" section that, "The length of the pad is identical to the length of the crib balusters down to but not below the crib mattress (viz. 18"–20")". This is a disadvantage because, even though the prior art is tapered at the bottom, over time and usage, it may slip below the mattress, thus leaving an upper area of the hard, wood slat exposed to the crib slat itself, and causing possible injury to a child, if impacted. This is especially true for the side of the crib that features the crib railing that raises and lowers, and is used many times during a typical day. In both cases, the pad could potentially slip down underneath the mattress on any side of the crib, and create the opportunity for an enterprising infant or toddler to use it as a step to climb out of the crib, which could cause serious injury.

4A) Crib safety experts recommend that the space between the mattress and crib not be larger than approximately 1½", or the width of two average fingers. Because the present invention is placed around the crib slat to include this space, it adds an element of safety that the prior art does not have.

5) The pads used in the prior art may be tapered to provide more padding toward the center of the crib slat, thus leaving the rest of the slat not as padded, and could injure a child more if they come in contact with the slat near its less padded top or bottom.

6) The most compelling disadvantage of the prior art is its inability to remain in a fixed vertical position if it incurs a force from the top, such as a child pushing down on it. The prior art states that its pad is placed around the crib slat and may be fastened by VELCRO™, a zipper, button, snap, or any other object that falls within the scope of the invention. It also states in the "Detailed Definition" section, that "Instead of a plastic, the pad exterior (i.e., pad cover or lining) may comprise cloth (preferably composed of synthetic fibers which are easy to clean, dry and maintain), or rubber, with or without additional (spongy) impact-absorbing batting placed within." With these materials comprising the pad of the prior art, an enterprising infant or toddler could push the pad halfway down and use it as a step to climb out of the crib. Again, like the bumper pad, the potential for injury is limitless.

6A) Another disadvantage similar to #6 is in regard for the pads which are used only on one to three sides, and are affixed only with VELCRO™. The possibility exists for an enterprising infant or toddler to push down on the pad and pull it off completely as it overcomes the adhesiveness of the fastener. The child may injure itself in the crib either with the broken/detached pad, or may use it to step out of the crib, again, injuring itself in numerable ways.

6B) When the prior art is used as a pad for only the interior side of the crib slat, or its interior plus the left and right sides, it shows in its drawings the use of adhesive VELCRO™ alone to adhere the pad to the crib slat. This is a disadvantage because the VELCRO™, when removed, may remove some of the wood it had been adhered to. This could disvalue the crib's appearance, and could pose a potential hazard (i.e., possible toxic hazard or choking hazard) to a child if flakes of wood were to come off into the crib.

7) The prior art states that it can be used anytime, regardless of the age of the child in the crib, from a newborn, until the child can be moved out of the crib to a regular bed. Because of the safety issue mentioned above, the prior art would have to removed from the crib when the child is able to sit or stand; because of its design, it represents the same safety issues that occur with the usage of bumper pads in the crib.

As noted above, there are many disadvantages to the prior art design. The need then arises for an improvement upon the prior art. The present invention will solve the problem of the prior art's ineffectiveness in safety. The present invention will show the functional and structural change of the prior art needed to allow a safe product to be introduced into the market for all infants and toddlers who remain in the crib until they are old enough to be transferred to a regular bed or toddler bed.

BRIEF SUMMARY OF INVENTION

The present invention overcomes the aforementioned disadvantages of the prior art in many ways. While the concept is similar, the design and emphasis on safety is distinct. The present invention is a simple, yet effective design; it is a rectangular, flat piece of soft material that is unilaterally stuffed with soft, resilient material, and then wrapped around each individual crib slat. The present invention is fastened to itself, and not the crib slat. Unlike the prior art, the present invention is not tapered, it covers the crib slat below the mattress, it does not adhere directly to the crib slat, and most importantly, it includes an upright safety support piece to ensure the pad will remain in a fixed, vertical position. The fixed, vertical position of the pad will disallow any enterprising infant or toddler from pushing down on the pad and using it as a step to climb out of the crib. The prior art does not have such device, and therefore its product could be pushed down, causing limitless possibilities of severe injury to a child. The design, minus the vertical support piece, is somewhat similar to a bumper pad that is folded and fastened around the crib slat.

In a preferred embodiment, the pad on the crib slat is similar to a mini bumper pad, in that it is soft on the outside, sufficiently padded on the inside, and simple for the parent or guardian to use. The present invention provides a safe environment for the occupant of the crib. The present invention is durable, washable, adjustable, and will protect occupants of the crib or playpen from injury on the crib slats.

The present invention solves the disadvantages of the prior art as listed in the "Background of the Invention" section. The advantages of the present invention are described below:

1) The present invention is padded on all 4 sides of a crib slat, thus entirely protecting a child from potential injury at any angle.

2) The present invention has padding of equal proportion around the slat, thus protecting the crib slat surface at all times from a child who may fall into it. It does not protrude more in any one spot, as the prior art appears to do.

3) The present invention fills the gap that is typically void between the mattress and the crib slats. The present invention extends below the mattress, to reach the bottom of the crib slat and touch the horizontal railing. Because the slat pad fills this gap, the pad cannot be moved out of place and/or pushed down any further, and thus the slat remains protected. As discussed earlier, the prior art does not extend below the mattress, creating a safety hazard if the prior art crib pad is pushed into this gap. The prior art pad could fall into this gap either by loosening around the slat caused by everyday use (wear-and-tear) or by a child pushing it into the gap. If the prior art is pushed into this gap, the pad is then low enough for a child to use the top portion as a step to climb out of the crib and potentially injure itself. Also, if the prior art is pushed into this gap, the upper part of the crib slat is then exposed and could create an injury if a child falls into it.

4) The present invention does not protrude unevenly on either side of the crib slat. The prior art, as it is designed in its drawing example, FIG. 1, appears to be wider on the right side of the crib slat. The present invention is uniformly wrapped around the crib slat and fastened in front of the crib slat (on the exterior of the crib).

5) The present invention is not pre-formed (i.e. rounded or curved) to automatically fit over the crib slat. It is a rectangular, flat piece of soft material that is filled with soft, resilient padding, with a safety support device that is sewn into the product to keep the slat pad in a fixed, vertical position (i.e. unbendable). The present invention has a fastener that is adjustable and therefore can be easily wrapped, and easily removed, around many variations of a crib slat, including a round one. Because of its flexibility in design, the present invention can be used on most crib designs.

6) The present invention is wrapped around the crib slat, and adheres to itself; it does not use VELCRO™ to adhere itself directly to the crib slat, such as the prior art uses in some instances. Adhering VELCRO™ to a crib slat is a hazard due to the possibility that an enterprising infant or toddler could pull down the prior art product and receive injury due to possible wood chips in the crib, or using the pad in an improper way after it has fallen into the crib. Since the present invention is tightly wrapped around a crib slat, adheres to itself and uses a stabilizing object, a child will not be able to push it down, pull it off, or move it in anyway, thus solving the safety problem presented in the prior art.

7) The present invention has an advantage to the prior art because it adheres to itself, and with the use of soft material, there is no possibility of marring or damaging the crib slat in any manner.

In regard to bumper pads, the advantages of the present invention are numerable. The present invention is fastened more securely around the crib slat and has a safety device to stabilize and ensure it cannot be moved away from the crib slat or used as a step. A bumper pad is typically only tied to the crib slats, and therefore, the strings may become loose by continual use and wear, and allow it to be moved away from the interior of the crib. A toddler could easily move a bumper pad up and down the slat, leaving parts of the slat exposed. Due to the inability of a bumper pad to remain in a fixed position, and because of its pillow-like softness, an infant could suffocate under a loosened bumper pad, or a toddler could push the bumper down and use it as a step to climb out of the crib, causing potential seriously injury to the child. With the use of the present invention, the occupant of the crib is substantially safer with its design as compared to the conventional bumper pad.

Because of the advantages listed above, the parent or guardian will be more assured of the safety of their child during the time spent in an unsupervised crib.

DETAILED DESCRIPTION OF THE INVENTION

The present invention is designed differently than the prior art to ensure it is a safe product to be used in an infant crib or playpen. Its structural and functional difference is utilized to create a product that will keep a crib slat pad in a stable, fixed, vertical position, and thus create a safe environment for the crib occupant. Unlike the prior art that appears to act more like a traditional bumper pad, the present invention will protect a child from birth until the age it can be moved from the crib to a regular or toddler bed.

The process of the present invention improves upon the design of the prior art in many ways, as outlined below. The present invention is more safe and durable, plus it takes the concept of the prior art to the next level in a baby proofing market that is constantly striving toward the protection of those who cannot independently protect themselves—our children. While a child sleeps, whether for a nap, or through the night, it is never more unsupervised than during the time spent in the crib. By inventing one major structural change in the prior art, the new function of the present invention will allow the young to be safe at anytime, while inhabiting their cribs.

Figure 1:
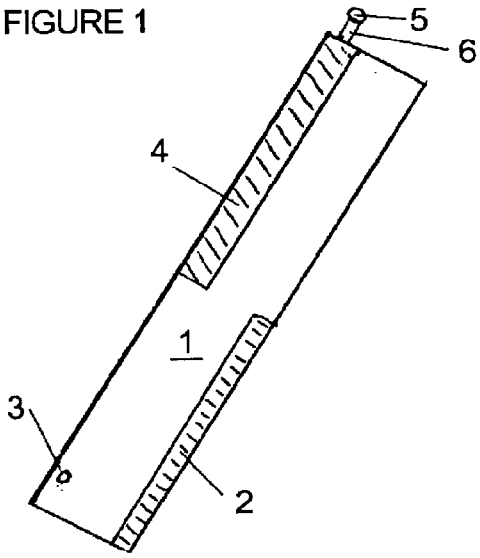
FIG. 1 is the initial piece of a rectangular, soft material that is used for the cover of the slat pad; shown are the various fasteners attached before it is folded, padded, and finished.
Figure 1A:
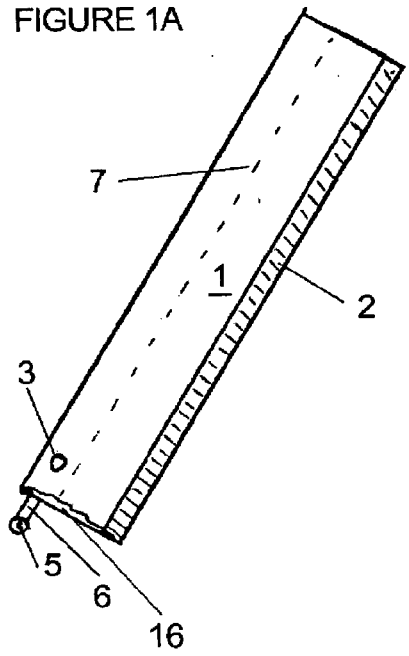
FIG. 1A is a drawing of the outside cover of the slat pad.
Figure 1B:
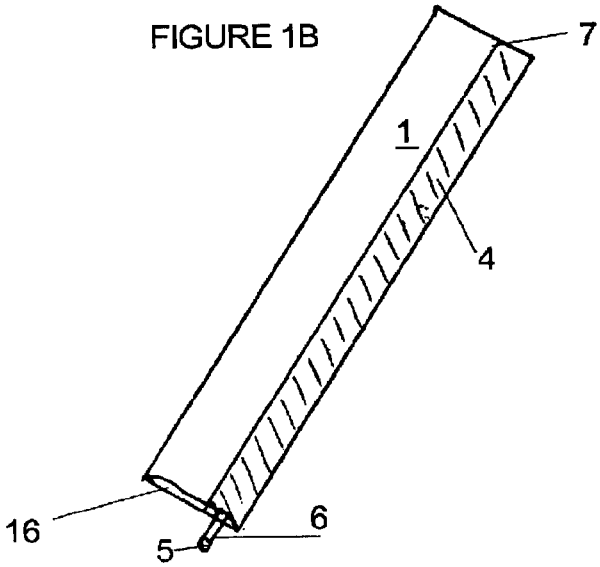
FIG. 1B is the backside of 1A (turned over from left to right), and is the inside cover of the slat pad; it is the side that will actually touch the crib slat.
Figure 2A:
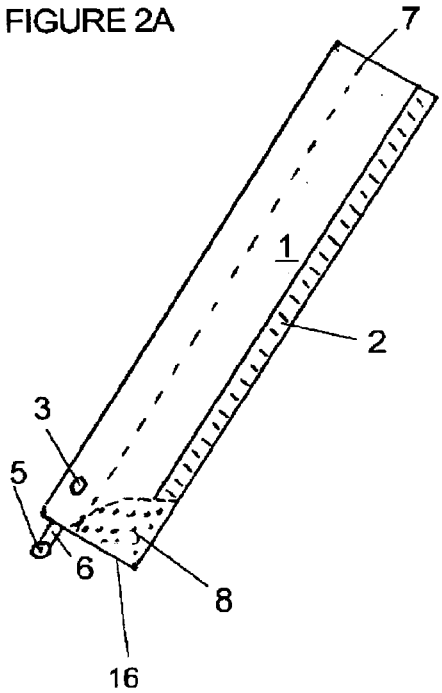
FIG. 2A is a cut-away view to show a detailed view of soft resilient material, i.e., padding, that comprises the inside of the slat pad. This is a view from the outside cover perspective.
Figure 2B:
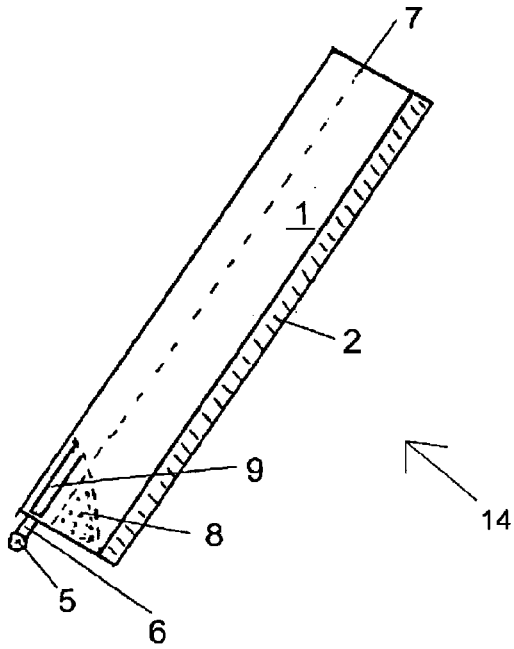
FIG. 2B is a cut-away view to show a detailed view of the stabilizer that is inserted in the slat pad. Again, the view is from the outside cover perspective.
Figure 3:
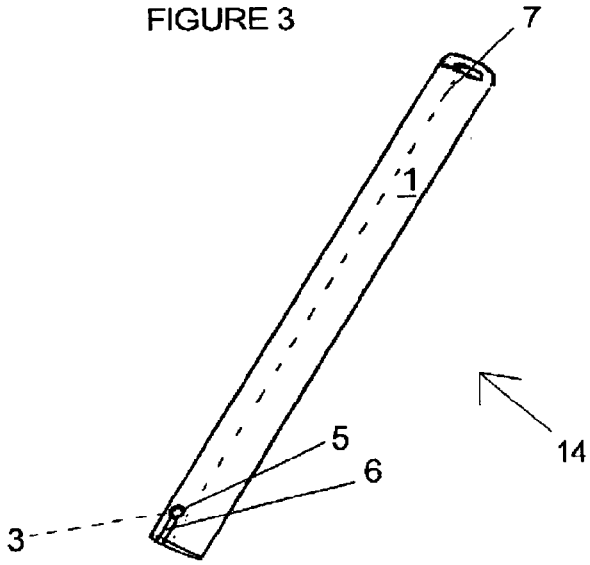
FIG. 3 is a view from the front of the present invention as a finished product, and as it would appear when wrapped around a crib slat (the crib slat is not shown).
Figure 4A:
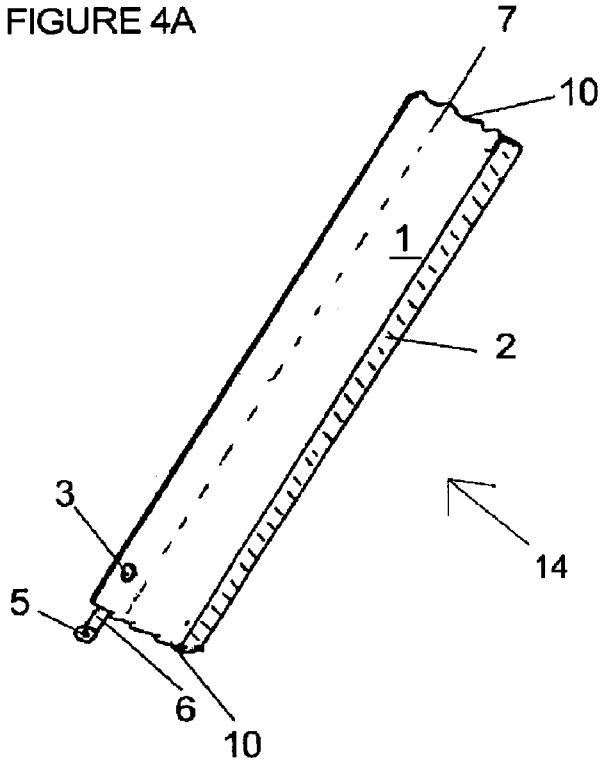
FIG. 4A is a drawing of the outside cover of the slat pad, with elastic on the top and bottom.
Figure 4B:
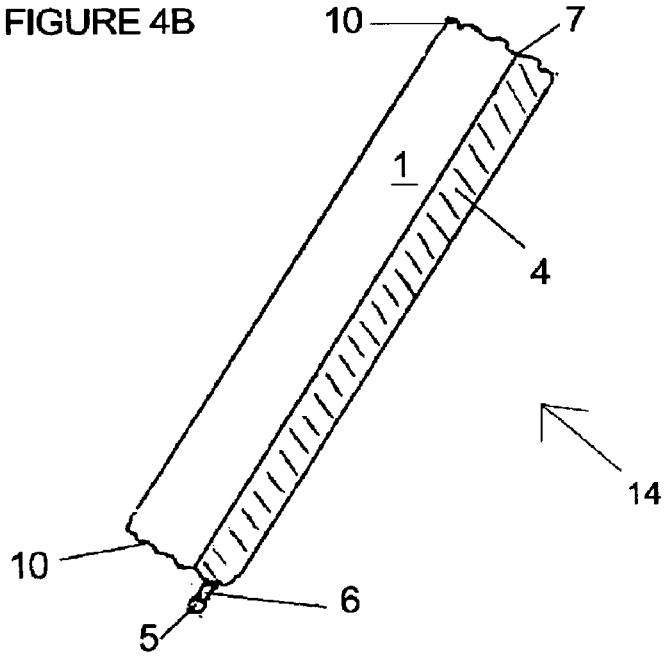
FIG. 4B is a drawing of the inside cover of the slat pad, with elastic on the top and bottom.
Figure 5:
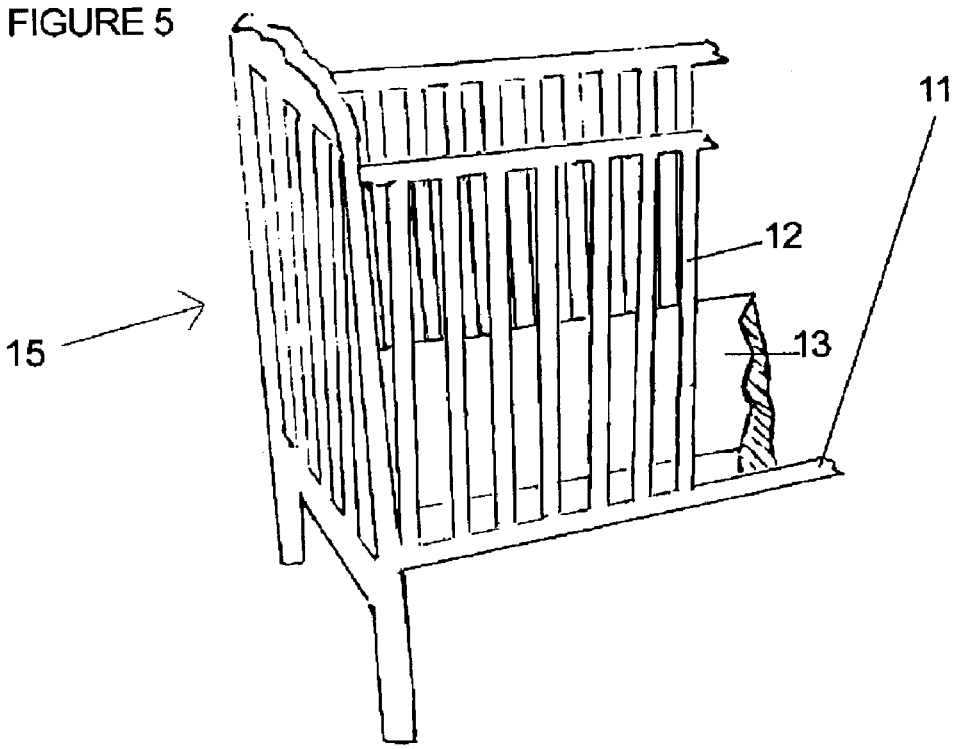
FIG. 5 is a partial drawing of a typical crib with its side railing in the raised position.
Figure 5A:
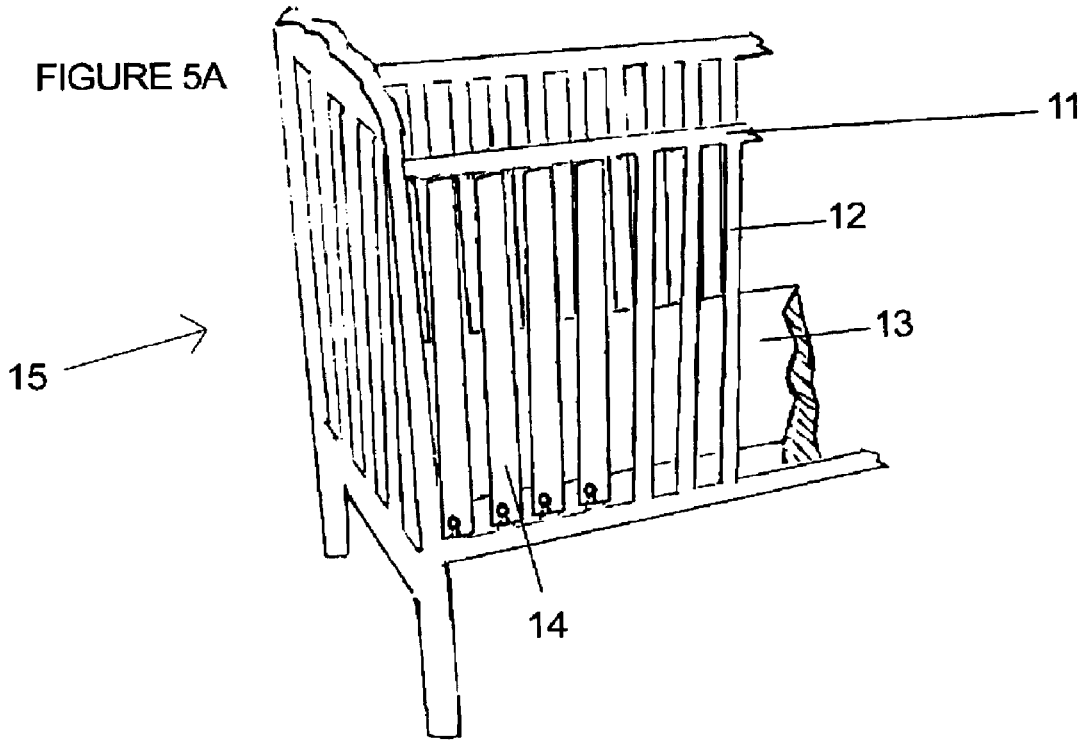
FIG. 5A is a partial drawing of the present invention, as it appears on a typical crib that has its side railing in the raised position.
Figure 6:
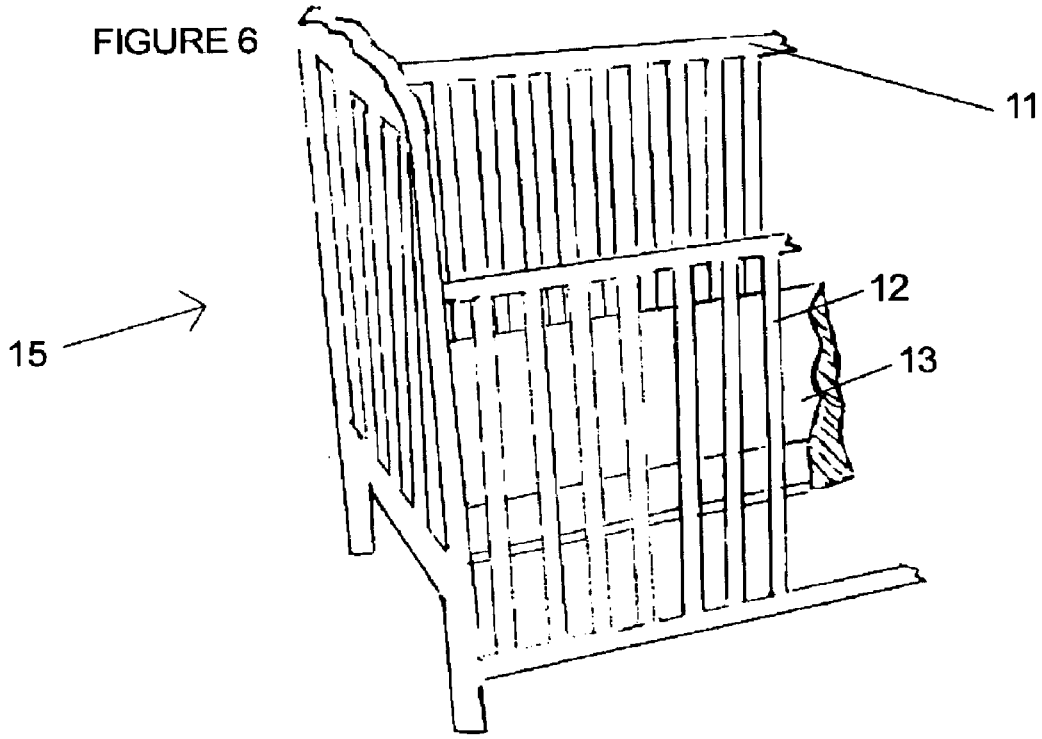
FIG. 6 is a partial drawing of a typical crib that has its side railing in the lowered/lowest position.
Figure 6A:
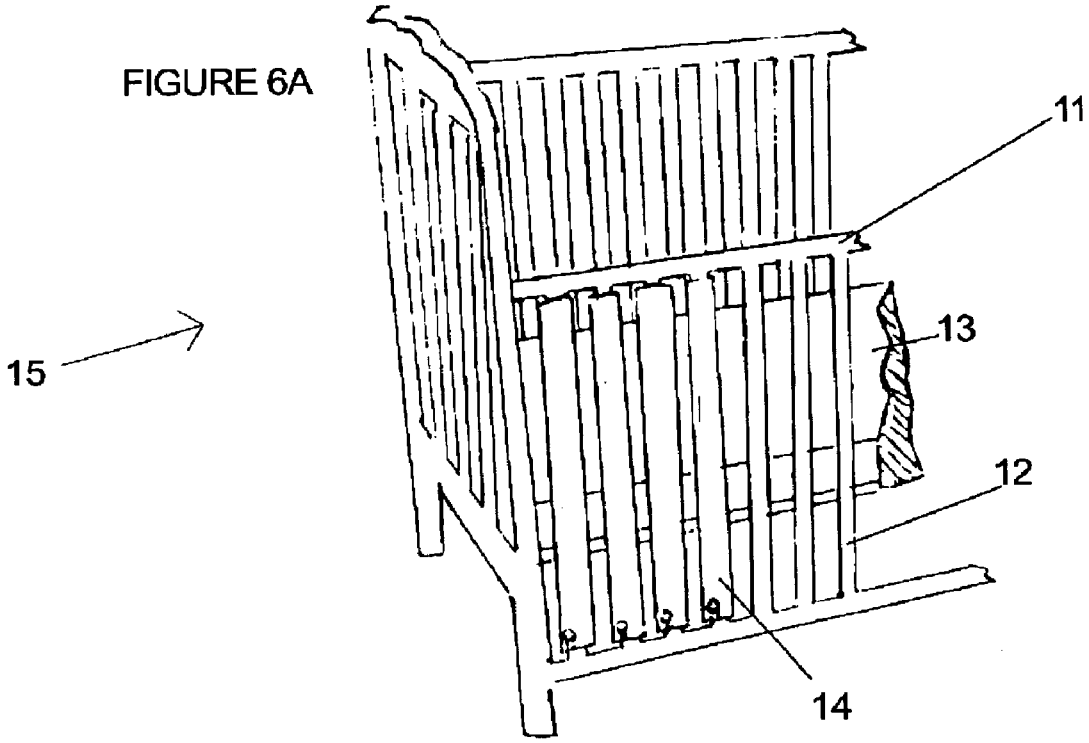
FIG. 6A is a partial drawing of the present invention, as it appears on a typical crib that has its side railing in the lowered/lowest position.

The preferred embodiment of the present invention includes the process outlined below, as could be followed by a person of ordinary skill in the art:

FIG. 1 depicts a cover 1, narrow fastener 2, bottom part of a snap 3, a wider fastener 4, the top half of the snap 5, and elastic 6. It shows a rectangular piece of a soft fabric material, such as cotton or cotton flannel that is approximately 7½ inches wide, and 55 inches long; this is the cover 1 of the slat pad 14 (shown in FIG. 3). FIG. 1 depicts a narrow fastener 2 such as VELCRO™, approximately ¾ inch wide, and 25½ inches long is sewn onto the bottom right side of the cover 1. Next, sew the bottom part of a snap 3 an inch above the lower left hand side of the cover 1. Then sew the top half of the snap 5 to one end of a ½ inch wide, and 1 inch long piece of elastic 6. Next place the other end of the elastic 6 that does not contain the top part snap 5 on the upper left hand side of the cover 1 where the wider fastener 4 will be sewn. The wider fastener 4, such as VELCRO™, approximately 1½ inch wide and 25½ inches long, is then sewn onto the top of the elastic 6 and cover 1 in the upper left outer portion of the cover 1. Fold the cover 1 over so narrow fastener 2 and wider fastener 4 are on the inside of the cover 1 (not shown in drawings); sew to create a seam on the outer edges, but do not sew where the padding 8 (as shown in FIG. 2A) will be inserted. Next, turn the cover 1 inside out, so the narrow fastener 2 and wider fastener 4 are on the outside of the cover 1 (FIG. 1). FIG. 1A depicts a cover 1, narrow fastener 2, bottom part of the snap 3, top part of a snap 5, elastic 6, stitch line 7, and 'opening' 16. Sew through both the front and back of the material to create a ⅝ inch margin with stitch line 7 on the left hand side; this is where the stabilizing object 9 (as shown in FIG. 2B) will be inserted. Also shown in FIG. 1A is an 'opening' 16 that is not to be initially sewed until other materials are inserted into the cavity of the cover 1. FIG. 1A depicts the portion of the cover 1 which will mostly be visible around the outside of the crib slat 12 (FIG. 5A) when folded and complete; FIG. 1B, with wider fastener 4, top part of the snap 5, elastic 6, stitch line 7, and 'opening'. When the top part of the snap 5 is affixed to the bottom part of the snap 3 (see FIG. 3), this will keep the stabilizing object 9 (FIG. 2B) in place, inside the cover 1. This feature allows the stabilizing object 9 to be removed when the cover 1 is in need of washing. Due to the type of material used in the slat pad 14, the slat pad 14 can be cleaned in a typical washing machine with regular detergent without displacing any of its materials. Also in a preferred embodiment is the creation of a flap from the cover 1 that is approximately the same width and length as the elastic 6/snap 5 feature, has the same function, but is used in its place. The initial measurements of the material used for the cover 1 is altered somewhat in this instance. Similarly to FIG. 1A, FIG. 4A depicts what the front side of the cover 1 looks like before it is folded around a crib slat 12 (FIG. 5A). FIG. 4A illustrates the slat pad 14 with cover 1, narrow fastener 2, bottom portion of snap 3, top part of snap 5, elastic 6, stitch line 7, and what the slat pad 14 looks like if longer elastic 10 is sewn at the top and bottom of the slat pad 14. Similarly to FIG. 1B, FIG. 4B depicts what the backside of the cover 1 looks like before it is folded around a crib slat 12 (FIG. 5A). FIG. 48 illustrates the slat pad 14 with cover 1, wider fastener 4, top part of snap of 5, elastic 6, stitch line 7, and what the slat pad 14 looks like with longer elastic 10 sewn around the top and bottom of the slat pad 14. Longer elastic 10 may be used to further ensure the hold the cover 1 would have against the crib slat 12 (FIG. 5) (although more for aesthetic purposes). FIG. 3 is a front view of the slat pad 14 when it is finished, folded, and in the position it will be used on the crib slat 12 (FIG. 5A). The slat pad 14 as shown in FIG. 3, is approximately 2¼ inches in diameter, 25 inches long, and approximately 2 inches wide. The finished slat pad 14 is wrapped around a crib slat 12 (FIG. 5A) and fastened on the front (exterior) of the crib 15; because it is padded, it easily compresses to fit in the space between the mattress 13 and crib 15. The front side of the cover 1 (FIG. 2B) has the stabilizing object 9 positioned in front of the crib slat 12 (FIG. 5A) so it will not come in contact with the baby. See FIGS. 5, 5A, 6, and 6A to view a partial drawing of a typical crib 15, with the horizontal railings 11, crib slats 12, and mattress 13. FIG. 5A depicts an example of how a few slat pads 14 appear on a typical crib 15 with only four placed around four individual crib slats 12 (the preferred embodiment would entail placing slat pads 14 on all slats 12 on a crib 15; the total number of crib slats 12 needed to comprise a typical crib is not shown in the partial drawings, 5, 5A, 6, and 6A). FIG. 6 shows a typical crib 15 with its side railing placed in the lowered position (the position used when taking a child out of the crib 15). FIG. 6A shows the slat pad 14 placed around four individual crib slats 12 on a crib 15 that has its side railing down (the preferred embodiment would 16, depicts the portion of the cover 1 which will mostly touch the crib slat 12 (FIG. 5A) when folded and complete, and will not be visible from the outside of the crib. FIG. 2A depicts a cover 1, narrow fastener 2, bottom part of the snap 3, top part of a snap 5, elastic 6, stitch line 7, padding 8, and 'opening' 16. Next, insert the soft, resilient material to be used as padding 8 (typically known as 'batting' and typically a polyester fiber, insert two inch of batting), into the opening 16, and fill the entire cavity; now the cover 1 is padded from top to bottom, and from left to right except for where the stabilizing object 9 (as shown in FIG. 2B) will be inserted. The padding 8 compresses so the padded cover 1 is approximately ¾ inch–1 inch in thickness after the cover 1 is sewn together. Next, sew the bottom edge to close a portion of the "opening", where the padding 8 was inserted, but do not sew the ⅝-inch margin where the stabilizing object 9 will be housed. Then insert the stabilizing object 9 into the remaining cavity. FIG. 2B depicts a cover 1, narrow fastener 2, top part of the snap 5, elastic 6, stitch line 7, padding 8, stabilizing object 9, which comprise the entire slat pad 14. See FIGS. 2A 2B for a cut-away view in the lower corner that show the contents of the cover 1, (i.e., the padding 8, and the padding 8 plus stabilizing object 9, respectively) if viewed from the outside portion of the cover 1. FIG. 3 shows the finished slat pad 14 as it appears folded, with stitch line 7, cover 1, plus the unseen bottom part of the snap 3 connected to the top part of the snap 6 and in a closed position with the elastic 6 combination to ensure the stabilizing object 9 (FIG. 2B) will stay contained inside the cover 1 (FIG. 3).

FIG. 2B shows that the stabilizing object 9 is a crucial, necessary safety item that will ensure the finished slat pad 14 will remain in a fixed, vertical position (as shown in FIGS. 5A and 6A) that could not be pushed down by an occupant of the crib 15. If a child is able to push down on any crib padding, which could occur in the prior art because of the materials used and its construction, the child could then use it as a step to climb out of the crib, and could incur severe injury. The stabilizing object 9 (FIG. 2B) eliminates that risk entirely. The stabilizing object 9 is a non-protruding piece of plastic or wood, or other appropriate material, that is either round or flat, with round, smooth edges, so as not to injure a child if the instructions for the slat pad 14 are not followed properly by a parent or guardian and the slat pad 14 is turned more toward the interior of a crib; (the stabilizing object 9 is inserted inside the slat pad 14 cover 1 with this side of the cover 1 on the exterior of the crib sat 12) (FIG. 5A). The stabilizing object 9 (FIG. 2B), if the round type is used, i.e., a dowel rod, is approximately 25 inches long, 7/16-inch wide, and ⅜-inch in diameter. If a flat piece is used for the stabilizing object, it is also 25 inches long, and 7/16-inch wide, but ⅜-inch thick. The round and flat piece need to meet this minimum dimension so they will not break easily if mishandled. Entail placing slat pads 14 on all crib slats 12 on a crib 15; the total number of crib slats 12 needed to comprise a typical crib is not shown in the partial drawing 6A).

FIG. 1B shows that because of the width of the wider fastener 4 (i.e. VELCRO™), the slat pad 14 (FIG. 3) is a product that can be adjusted to fit on virtually any crib structure. While in use, the function of the slat pad 14 is to ensure the slat pad 14 will remain in a fixed, vertical position at all times, and thus, protect the occupant of a crib.

A person of ordinary skill in the art would recognize the various possibilities of using similar types of materials in the make-up of the slat pad 14, yet still remain within the scope of the invention. For example, in other embodiments, comparable material for the cover 1 of the slat pad 14 could be comprised of plastic, such as vinyl, or a different type of fabric, such as polyester, the inside of the cover 1 could be padded 8 (FIG. 2B) with foam rubber or similar sponge-like material; the slat pad 14 could have a stabilizing object 9 to comprise the entire cavity of the cover 1, and encompass the entire slat pad 14, instead of just one part (i.e. a stay or boning could be used, such as the type of material used for support in an under wire bra); and a means of fastening may be used, such as a zipper, or (less preferred) buttons in addition to the previously mentioned narrow fastener 2 or wider fastener 4 (FIG. 1). The item that closes the area where the stabilizing object 9 (FIG. 2B) is housed (i.e. elastic 6/snap 5 feature or flap that is made out of cover 1 material) could also be an extra wide piece of bias tape, which would serve the same function. The slat pad 14 could be elongated to cover more than one crib slat 12 (FIG. 5), with the stabilizing object 9 (FIG. 2B) inserted in front of every individual crib slat 12 (FIG. 5) to ensure it remains in a fixed, upright position (there is no drawing of this example). The design of the cover 1 (FIG. 3) could be changed to match the baby's bedding and/or nursery theme. The slat pad 14 could be used on cribs made out of metal, or any other type of material. Many alternative materials in the marketplace could be used to obtain the main objective, which is to create a slat pad 14 that will securely pad a crib slat 12 (FIG. 5A), remain immovable around the slat 12, keep the slat pad 14 in a fixed, vertical position, and thus a safe environment for an infant or toddler while in the crib 15.

From the top of the crib slat 12 to the bottom, the slat pad 14 covers as much surface of the individual crib slat 12 as possible; this includes the space between the top of the mattress 13 surface, to the bottom of the mattress 13 and crib slat 12, which is novel. Because this area of the crib slat 12 (FIG. 5A) is protected, and because the slat pad 14 will rest on the lower horizontal railing 11 of the crib 15, an enterprising infant or toddler could not push the slat pad 14 down any further to use it as a step to climb out of the crib 15. (See FIG. 5A and 6A to view the slat pad 14 coverage).

To summarize, the present invention overcomes al safety issues raised in regard to bumper pads and the prior art. Children should always be supervised, but during those unavoidable times when they are left alone in the crib, parents and guardians can use this product knowing their children will be protected.

I claim:

1. A padded safety device for the individual vertical supports of a crib or playpen that consists of:

a cover made of soft material that has an internal and external side, with said internal side having an enclosed hollow space;

a soft resilient material that fills said hollow space;

a stabilizing object contained in said hollow space, such that said stabilizing object allows said padded safety device to remain in a fixed, upright position, while in use on said vertical supports;

the ability to wrap around said vertical supports;

a means to fasten said padded safety device to itself;

a length that reaches approximately the height of said vertical supports;

a length that reaches the bottom of said vertical supports.

* * * * *